US007352656B2

(12) United States Patent
Nirasawa

(10) Patent No.: US 7,352,656 B2
(45) Date of Patent: Apr. 1, 2008

(54) RADIO WAVE TIMEPIECE

(75) Inventor: Shoji Nirasawa, Chiba (JP)

(73) Assignee: Seiko Instruments Inc. (JP)

( * ) Notice: Subject to any disclaimer, the term of this patent is extended or adjusted under 35 U.S.C. 154(b) by 21 days.

(21) Appl. No.: 11/356,630

(22) Filed: Feb. 17, 2006

(65) Prior Publication Data

US 2006/0187132 A1 Aug. 24, 2006

(30) Foreign Application Priority Data

Feb. 22, 2005 (JP) ..... 2005-046098

(51) Int. Cl.
*G04B 37/00* (2006.01)

(52) U.S. Cl. ..... 368/47; 368/281

(58) Field of Classification Search ..... 368/47, 368/281, 88

See application file for complete search history.

(56) References Cited

U.S. PATENT DOCUMENTS 5,430,693 A * 7/1995 Ganter et al. ..... 368/47
6,134,188 A * 10/2000 Ganter et al. ..... 368/47
6,411,569 B1 * 6/2002 Megner et al. ..... 368/43
7,091,916 B2 * 8/2006 Paratte ..... 343/718
7,102,963 B2 * 9/2006 Matoge et al. ..... 368/47
7,190,638 B2 * 3/2007 Oguchi ..... 368/47
2002/0044501 A1 * 4/2002 Sato ..... 368/281
2004/0145975 A1 * 7/2004 Barras et al. ..... 368/281
2005/0018543 A1 * 1/2005 Fujisawa ..... 368/47
2005/0195689 A1 * 9/2005 Oguchi ..... 368/47
2006/0171258 A1 * 8/2006 Nirasawa ..... 368/47

* cited by examiner

*Primary Examiner*—Gary F. Paumen
(74) *Attorney, Agent, or Firm*—Adams & Wilks

(57) ABSTRACT

A radio wave timepiece has a movement having a circular main plate, a plastic train wheel bridge that supports a fourth wheel & pinion, and a ferrite antenna. The antenna is disposed in a recess formed by the main plate and is curved along an outer periphery of the circular main plate. A plastic antenna cover at the back side of the movement covers the recess, and part of the plastic antenna cover constitutes a plastic seat on which seats the train wheel bridge. The plastic seat functions as a hand pushing receive seat during attachment of time-indicating hands to the movement. A metal pin is attached to a stepped through-hole in the antenna cover at a given distance from an end of a fourth stem of the fourth wheel & pinion. A plurality of push up projections, one on the plastic seat and the others on the main plate, project toward the back side of the movement to support the main plate and plastic seat during attachment of the time-indicating hands.

15 Claims, 6 Drawing Sheets

RADIO WAVE TIMEPIECE

BACKGROUND OF THE INVENTION

1. Field of the Invention

The present invention relates to a radio wave timepiece having a fourth wheel & pinion receive pin as an essential constituent element of a hand attaching structure.

2. Description of the Prior Art

In a portable electronic timepiece of a background art, according to a movement using a train wheel bridge of a plastic member, when a second hand is attached thereto, a metal plate is brought into contact with a lower side of a fourth stem to thereby prevent a fourth wheel & pinion from being buckled by the train wheel bridge by attaching the hand. Further, when in view of a structure of the movement, a part having a height higher than the train wheel bridge is present and the fourth stem cannot be received, there is adopted a structure of providing a metal part such as a fourth wheel & pinion receive pin made of a metal at the lower portion of the fourth stem. For example, JP-A-2001-162333 discloses a portable electronic timepiece attaching a fourth wheel & pinion receive pin made of a metal to a battery frame by providing a certain distance from a fourth stem of the fourth wheel & pinion. A load in attaching a hand is applied to the fourth wheel & pinion and is transmitted to a train wheel bridge of a plastic member of the movement. Up to a constant load, a fourth wheel & pinion support portion of the train wheel bridge is elastically deformed, the fourth stem gradually approaches a receive face of the fourth wheel & pinion receive pin, and when the fourth stem reaches the receive face of the fourth wheel & pinion receive pin, the fourth wheel & pinion receive pin receives the load. The load applied from a flanged receive portion of the fourth wheel & pinion receive pin to a battery frame is applied to a case back push up projection of the battery frame and a base receive portion of the fourth wheel & pinion receive pin and is applied uniformly to a base on which the movement is placed. Thereby, respective hands of an hour hand, a minute hand and the second hand can be attached in a state of the movement.

Meanwhile in a portable electronic timepiece with an antenna constituted by newly arranging an antenna part to a movement of a background art, a so-to-speak portable radio wave timepiece has been developed, the antenna part is the largest in parts constituting the movement and therefore, with regard to a hand pushing structure, a problem described below is posed.

That is, as shown by a plane view of a back side of a movement of FIG. 4 and a sectional view directing the back side of the movement downward of FIG. 5, the portable radio wave timepiece having the fourth wheel & pinion receive pin made of a metal disclosed in JP-A-2000-162333 is constituted by a main plate 4 in a circular shape formed with six pieces of push up projections at an outer peripheral portion thereof, a circuit board 6 attached to the main plate 4, a train wheel held by a train wheel bridge 5 of a plastic member, an antenna 8 contained in an antenna containing recess portion 4*a* of the main plate 4, a battery frame 20 containing a battery 10, and a metal pin 12 attached to the battery frame 20. The metal pin 12 is a part functioning as a fourth wheel & pinion receive pin made of a metal.

The antenna containing recess portion 4*a* is formed in a shape of a circular arc over substantially near to a half periphery on an inner side of the outer peripheral portion of the main plate 4 formed with the push up projections 9. A position of forming the antenna containing recess portion 4*a* is disposed on a side opposed to the containing recess portion of the battery 10 relative to a center of the main plate 4 in the circular shape. The antenna 8 contained in the antenna containing recess portion 4*a* is constituted by winding a wire around an antenna core 8*a* in a shape of a circular arc having a section substantially in a square shape.

The battery frame 20 is a plastic plate member having substantially a triangular shape substantially covering a half of the main plate 4 in the circular shape. A right side thereof is a region formed with the antenna containing recess portion, and a left side thereof is a region having a circular arc proximate to the antenna containing recess portion 4*a*. The battery frame 20 arranged by being partially brought into contact with a back face of the circuit board 6. Therefore, the train wheel bridge 5 of the plastic member is arranged between the main plate 4 and the battery frame 20 by interposing the circuit board 6.

The antenna 8 is a large part having a section almost reaching the back side of the movement from a top side thereof. Therefore, a back face side of the antenna 8 is projected from a back face of the circuit board 6. An amount of projecting the antenna 8 from the back face of the circuit board 6 is about three times as much as a thickness of the circuit board 6.

The metal pin 12 is a flanged metal pin formed with a flange at one end thereof. Further, the battery frame 20 is formed with a stepped through hole 13 to be inserted with the metal pin 12 from an upper side. Other end of the metal pin 12 is projected from the back face of the battery frame 20. An amount of projecting the metal pin 12 from the back face of the metal pin 12 is about a half of a thickness of the battery frame 20.

The push up projections 9 formed integrally with the main plate 4 are arranged substantially symmetrically in a left and right direction by three pieces on a right side and three pieces on a left side at the outer peripheral portion of the main plate 4 in the circular shape at intervals thereamong. Each push up projection 9 is a projection in a shape of a small circular cylinder having a front end portion in a conical shape. An amount of projecting the push up projection 9 from the back face of the battery frame 20 and therefore, an amount of projecting the push up projection 9 from the back face of the movement is made to be slightly larger than the amount of projecting the metal pin 12 from the back face of the battery frame 20. In sum, a front end of the push up projection 9 is projected more than the back face side of the antenna and more than the front end of the metal pin 12.

In the above-described movement, an attaching operation of attaching an hour hand 16 to a front end of an hour wheel, attaching a minute hand 15 to a front end of a support shaft of a center wheel & pinion in a shape of a cylinder and attaching a second hand 14 to a front end of a support shaft of a fourth wheel & pinion, respectively, is carried out by an assembling operator by using a metal plate 17 for attaching the hands placed on an operation base. That is, as shown by FIG. 5, the movement assembled up to a state immediately before attaching the time-indicating hands is mounted on the metal plate 17. Then, the front end portions of the push up projections 9 formed at the outer peripheral portion of the main plate 4 in the circular shape at substantially equal angular intervals are put into predetermined shallow mount holes formed at a surface of the hand attaching metal plate 17. At the same time, the front end of the metal pin 12 arranged at the stepped through hole 13 of the battery frame 20 is brought into contact with the surface of the hand attaching metal plate 17. Thereby, the assembling operator can carry out the operation of attaching the hands of the radio wave timepiece without buckling or destructing the train wheel bridge 5 of the plastic member and therefore, without destructing the antenna 8.

Next, FIG. 6 shows a hand attaching structure in which a case back 3 of an exterior of the radio wave timepiece is made to serve also as the above-described metal plate. In FIG. 6, constitutions of the antenna 8 and the movement are the same as those shown in FIG. 4 and FIG. 5, mentioned above. Owing to such a structure, the assembling operator can carry out the operation of attaching the hands of the radio wave timepiece without buckling or destructing the train wheel bridge of the plastic member and therefore, without destructing the antenna.

However, according to the above-described hand attaching structure of the background art, that is, the hand attaching structure in which the fourth wheel & pinion receive pin made of the metal is provided at the battery frame of the plastic member and the plurality of push up projections are provided at the outer peripheral portion of the main plate in the circular shape substantially at equal angular intervals, there poses a problem that a planar size becomes large. Because an extra space for providing the plurality of push up projections substantially at equal angular intervals is needed at the outer peripheral portion of the main plate in the circular shape. Conversely, when the planar size of the radio wave timepiece is not made to be large, a size of the antenna cannot be made to be large and therefore, there poses a problem that a necessary receiving sensitivity cannot be ensured.

Further, although according to the radio wave timepiece having the above-described hand attaching structure of the background art in which the fourth wheel & pinion receive pin made of the metal is provided at the battery frame of the plastic member and the plurality of push up projections are provided at the outer peripheral portion of the main plate in the circular shape substantially at equal angular intervals, the battery frame of the plastic member substantially in the triangular shape covering the half of the main plate in the circular shape is adopted, an outer edge of the region on a side opposed to the region formed with the battery containing recess portion is proximate to the antenna containing recess portion. Therefore, the antenna is exposed on the back face side of the movement. Therefore, there also poses problem that the assembling operator is erroneously brought into contact with the antenna.

It is a problem to be resolved by the invention to make a planar size of a radio wave timepiece small and prevent an antenna from being exposed from an antenna containing recess portion in the radio wave timepiece having a fourth wheel & pinion receive pin made of a metal as an essential constituent element of a hand attaching structure.

SUMMARY OF THE INVENTION

In order to resolve the above-described problem, there is provided a radio wave timepiece including a movement having a main plate in a circular shape and a train wheel bridge of a plastic member and containing an antenna at an antenna containing recess portion of the main plate, wherein the antenna containing recess portion is formed at an outer peripheral portion of the main plate to be proximate to an outer edge thereof, a hand pushing receive seat of a plastic member is arranged on a back side of the movement, a fourth wheel & pinion receive pin is attached to the hand pushing receive seat of the plastic member by providing a certain constant distance from a fourth stem of the fourth wheel & pinion, and a plurality of push up projections are provided at the outer peripheral portion of the main plate which is not influenced by an arrangement of the antenna.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

According to the invention, in a radio wave timepiece including a movement having a main plate in a circular shape and a train wheel bridge of a plastic member and containing an antenna at an antenna containing recess portion of the main plate, the antenna containing recess portion is formed at an outer peripheral portion of the main plate by making an outer edge thereof proximate thereto. Further, a hand pushing receive seat of a plastic member is arranged on a back side of the movement, and a fourth wheel & pinion pin is attached to the hand pushing receive seat of the plastic member by providing a certain constant distance from a fourth stem of a fourth wheel & pinion. Further, a plurality of push up projections are provided at the outer peripheral portion of the main plate which is not influenced by an arrangement of the antenna.

Figure 1:
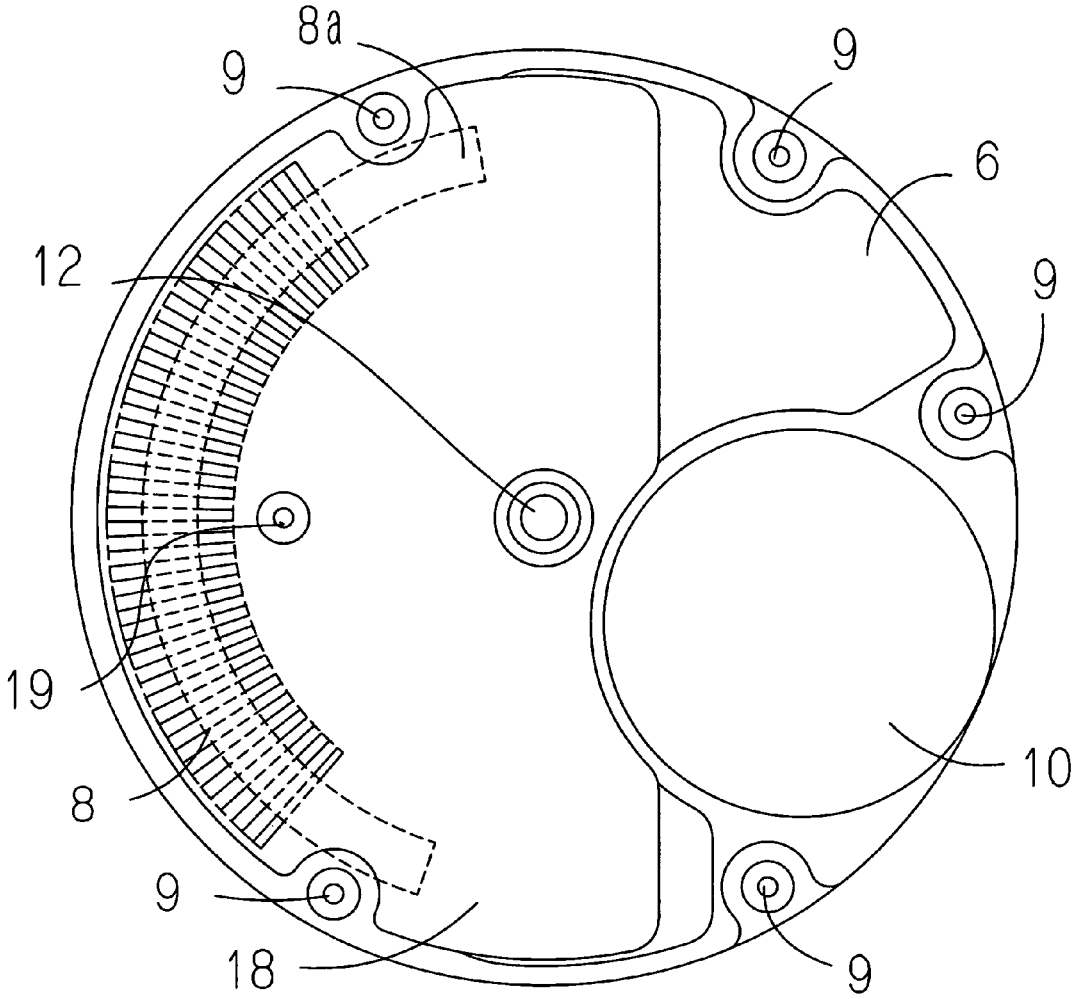
FIG. 1 is a plane view of a back side of a movement according to Embodiment 1 of the invention.
Figure 2:
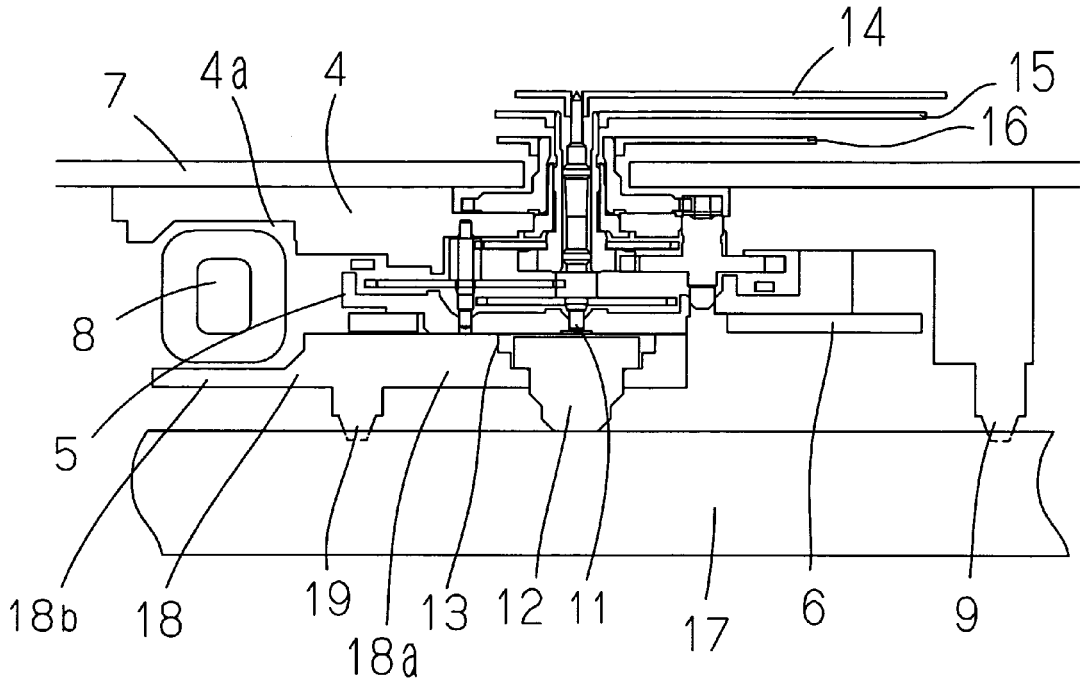
FIG. 2 is a sectional view directing the back side of the movement of Embodiment 1 of the invention downward.

As shown by a plane view of a back side of a movement of FIG. 1, and a sectional view directing a back side of the movement downward of FIG. 2, a portable radio wave timepiece of Embodiment 1 of the invention is constituted by including a main plate 4 in a circular shape formed with five pieces of push up projections 9 at an outer peripheral portion thereof, a circuit board 6 attached to the main plate 4, a train wheel held by a train wheel bridge 5 of a plastic member, an antenna 8 contained in an antenna containing recess portion 4*a* of the main plate 4, an antenna cover 18 functioning as a hand pushing receive seat of a plastic member, a metal pin 12 attached to the antenna cover 18, and a battery 10 contained in a battery containing recess portion. The metal pin 12 is a part functioning as a fourth wheel & pinion receive pin made of a metal. Further, it is not necessary that the metal pin 12 is made of a metal so far as a function similar to that of the metal pin is provided and a pin made of a plastic may be used in place of the metal pin 12.

An antenna containing recess portion 4*a* is formed in a shape of circular arc at the main plate 4 over near to substantially a half periphery thereof by being partially put into an outer peripheral portion of the main plate 4 formed with the push up projection 9. That is, the antenna containing recess portion 4*a* is formed at the outer peripheral portion of the main plate 4 in the circular shape to be proximate to an outer edge thereof. A position of forming the antenna containing recess portion 4*a* is disposed on a side opposed to a containing recess portion of a battery 10 relative to a center of the main plate 4 in the circular shape. The antenna 8 contained in the antenna containing recess portion 4*a* is constituted by winding a wire around a ferrite core 8*a* in a shape of a circular arc having a section substantially in a square shape.

The antenna cover 18 is a plastic plate member substantially in a shape of a circular arc substantially covering and overlapping about three quarters of the main plate 4 in the circular shape and is arranged to be partially brought into contact with a back face of the circuit board 6. Therefore, the train wheel bridge 5 of the plastic member is arranged between the main plate 4 and the antenna cover 18 by interposing the circuit board 6 therebetween and, as shown in FIG. 2, the train wheel bridge 5 contacts and seats on the hand pushing receive seat of the antenna cover 18. An outer peripheral region of the antenna cover 18, that is, an antenna cover portion 18*b* totally covers the curved antenna 8 contained in the antenna containing recess portion 4*a* at the back side of the movement.

The antenna 8 is a large part having a section almost reaching a back side of the movement from a top side thereof. Therefore, a back face side of the antenna 8 is projected from the back face of the circuit board 6. An amount of projecting the antenna 8 from the back face of the circuit board 6 is about three times as much as a thickness of the circuit board 6.

The metal pin 12 is a flanged metal pin formed with a flange at one end thereof. Further, the antenna cover 18 functioning as a hand pushing receive seat of the plastic member is formed with a stepped through hole 13 constituted by inserting a flanged metal pin into a hand pushing receive seat portion 18*a* from an upper side. Other end of the pin 12 made of a metal is projected from a back face of the antenna cover 18. An amount of projecting the metal pin 12 from the back face of the antenna cover 18 is to a degree of being the same as a thickness of the hand pushing receive seat portion 18*a* of the antenna cover 18.

The push up projections 9 formed integrally with the main plate 4 are arranged at the outer peripheral portion of the main plate in the circular shape by three pieces thereof on a right side and two pieces thereof on a left side. Further, also the antenna cover 18 is provided with one piece of a push up projection 19. A position of providing the push up projection 19 is disposed at a center of a circular arc of the hand pushing receive seat portion 18*a* contiguous to the antenna cover portion 18*b*. The push up projections 9 and 19 are projections in a shape of a small circular cylinder having front end portions in a conical shape. An amount of projecting the push up projections 9 and 19 from the back face of the antenna cover 18 is slightly larger than the amount of projecting the metal pin 12 from the back face of the antenna cover 18. In sum, front ends of the push up projections 9 and 19 are projected more than a back face side of the antenna 8 and projected more than a front end of the metal pin 12.

In the above-described movement, an attaching operation of attaching an hour hand 16 to a front end of an hour wheel, attaching a minute hand 15 to a front end of a support shaft of a center wheel & pinion in a shape of a cylinder and attaching a second hand 14 to a front end of a support shaft of a fourth wheel & pinion, respectively, is carried out by an assembling operator by using a hand attaching metal plate 17 placed on an operation base. That is, as shown by FIG. 2, the movement assembled up to a state immediately before attaching the time-indicating hands is mounted on the metal plate 17. Then, front end portions of the push up projections 9 formed at the outer peripheral portion of the main plate 4 in the circular shape substantially at equal angular intervals and a front end portion of the push up projection 19 formed at the antenna cover 18 are put into predetermined shallow mount holes formed at a surface of the hand attaching metal plate 17. At the same time, the front end of the metal pin 12 arranged at the stepped through hole 13 of the antenna cover 18 is brought into contact with the surface of the hand attaching metal plate 17. Thereby, the assembling operator can carry out the hand attaching operation of the radio wave timepiece without buckling or destructing the train wheel bridge 5 of the plastic member and therefore, without destructing the antenna.

Figure 3:
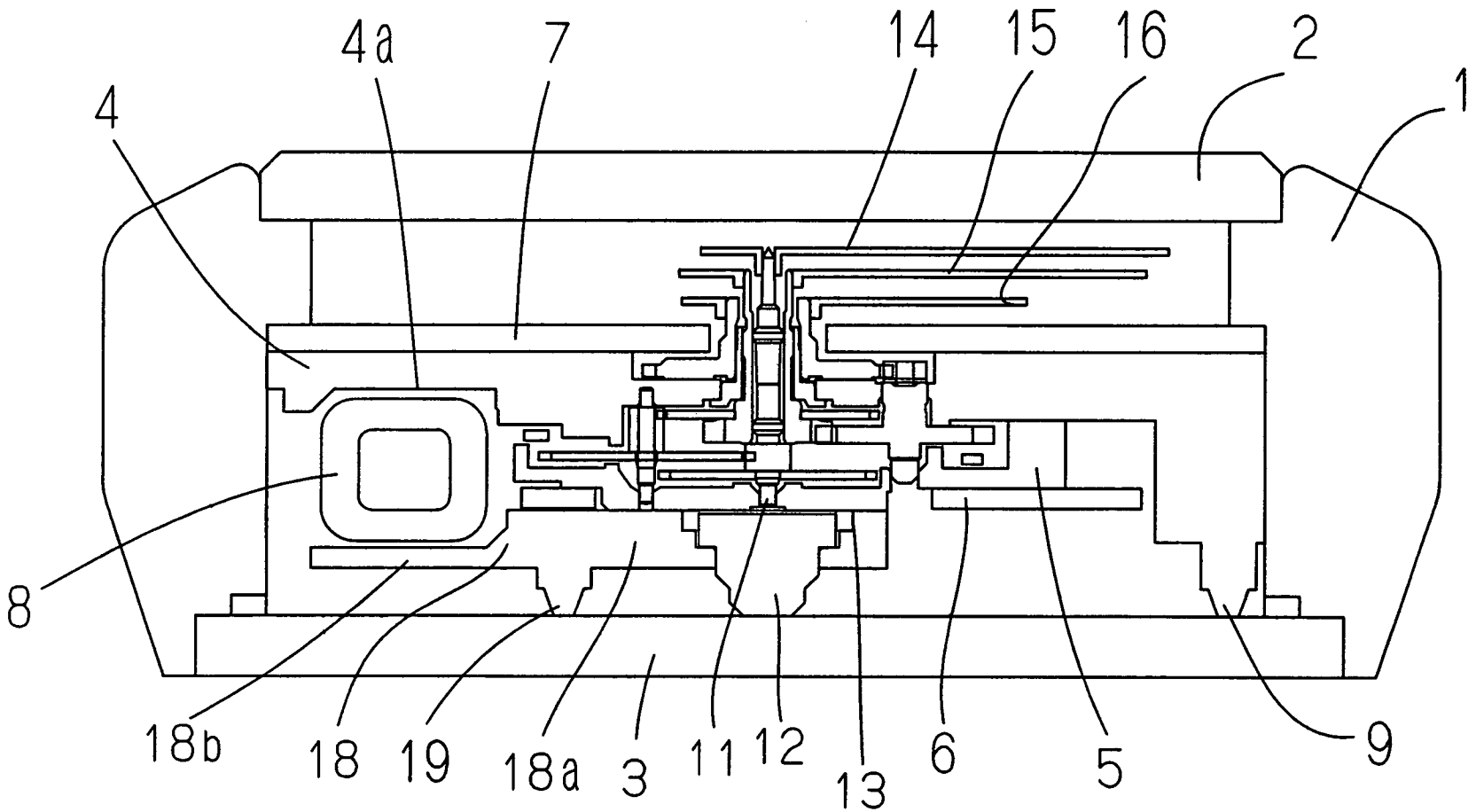
FIG. 3 is a sectional view directing a back side of a movement of a modified example of Embodiment 1 of the invention downward.
Figure 4:
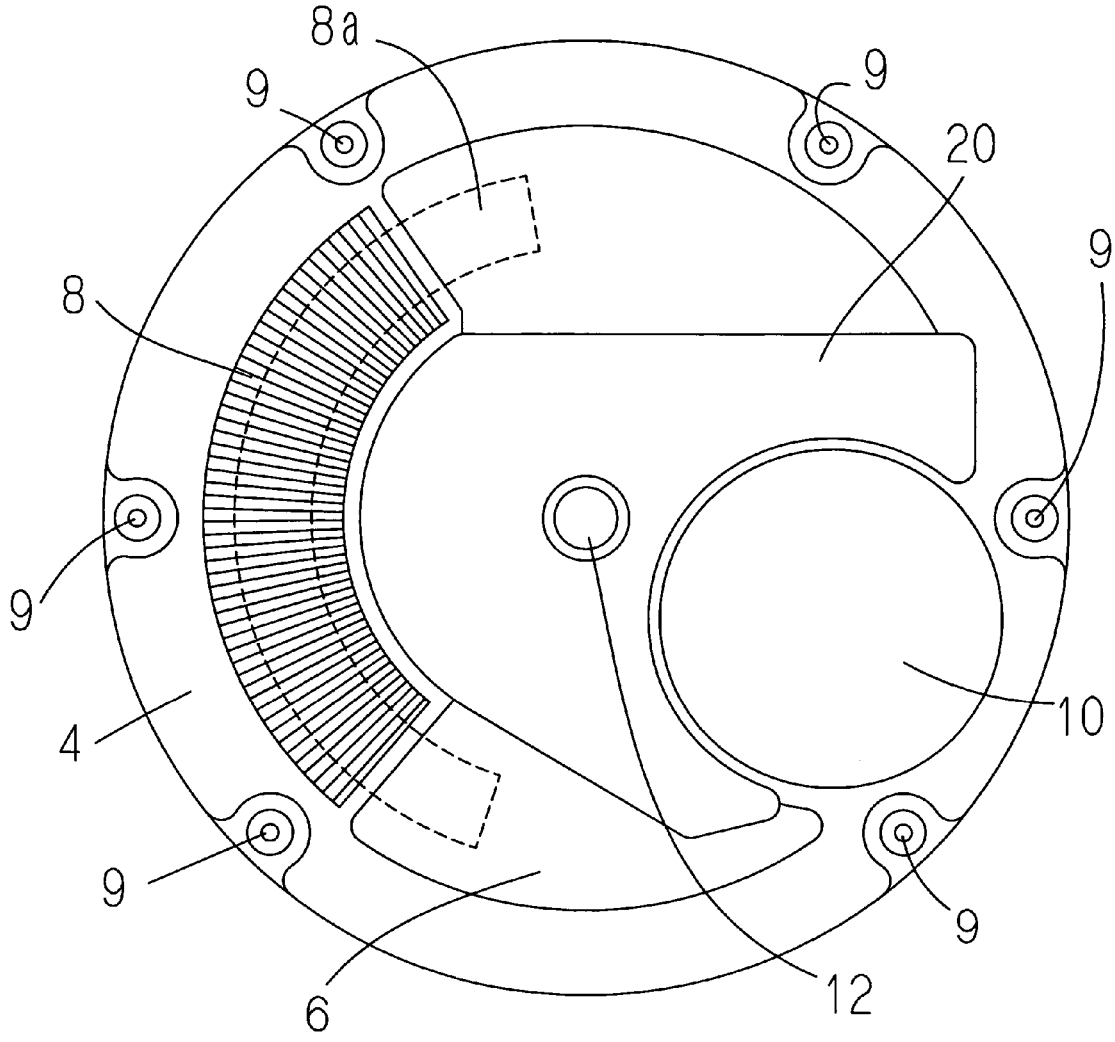
FIG.4 Prior Art
FIG. 4 is a plane view of a back side of a movement of a radio wave timepiece of a background art.
Figure 5:
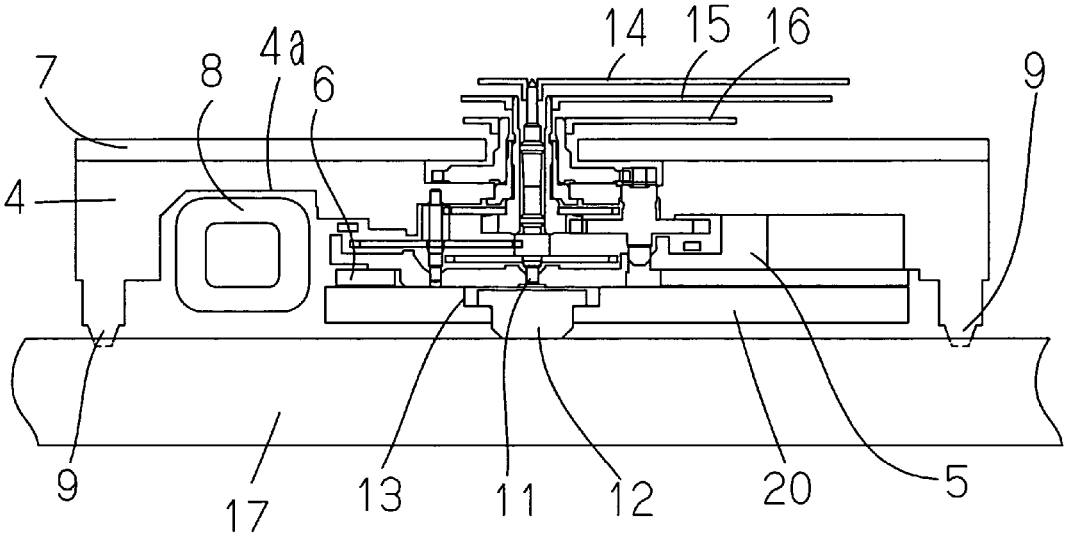
FIG.5 Prior Art
FIG. 5 is a sectional view directing the back side of the movement of the radio wave timepiece of the background art downward.
Figure 6:
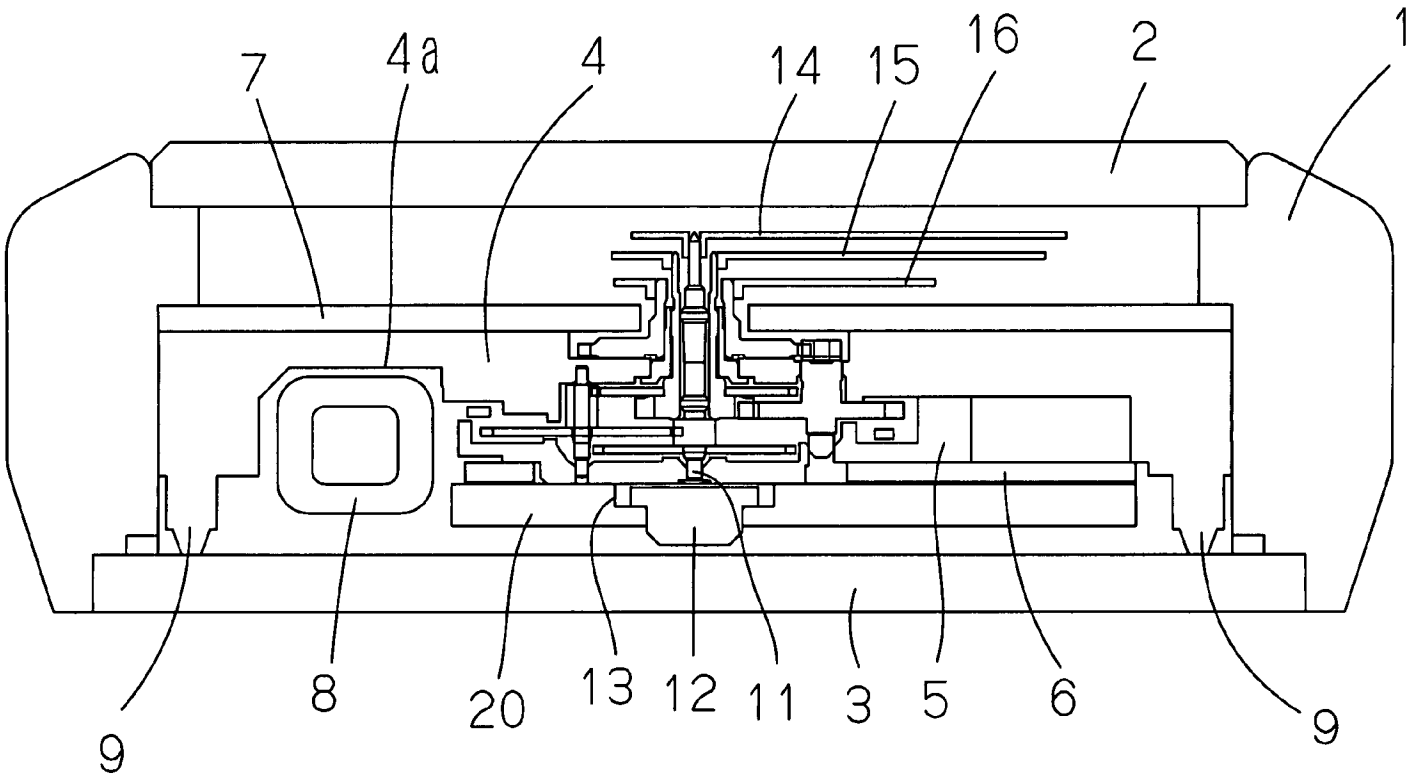
FIG. 6 Prior Art
FIG. 6 is a sectional view directing a back side of a movement of a modified example of the radio wave timepiece of the background art downward.

Next, FIG. 3 is a sectional view directing a back side of the movement of a modified example of Embodiment 1 downward. That is, the radio wave timepiece of the modified example of Embodiment 1 is characterized in that a case back 3 is made to serve also as the metal plate 17 of Embodiment 1 in the radio wave timepiece constituted by the main plate 4 in the circular shape formed with five pieces of the push up projections at the outer peripheral portion, the circuit board 6 attached to the main plate 4, the train wheel held by the train wheel bridge 5 of the plastic member, the antenna 8 contained in the antenna containing recess portion 4*a* of the main plate 4, the antenna cover 18 which is a member functioning as the hand pushing receive seat of the plastic member and formed with one piece of push up projection 19, the metal pin 12 attached to the antenna cover 18, and the battery 10 contained in the battery containing recess portion. Owing to the structure, the assembling operator can carry out the hand attaching operation of the radio wave timepiece without buckling or destructing the train wheel bridge 5 of the plastic member and therefore, without destructing the antenna.

By the invention, in the radio wave timepiece including the fourth wheel & pinion receive pin as an essential constituent element of a hand attaching structure, a planar size of the radio wave timepiece can be made to be small and the antenna can be prevented from being exposed from the antenna containing recess portion. Further, the hand pushing receive seat of the plastic member attached with the fourth wheel & pinion receive pin is made to serve as an antenna cover and therefore, an increase in the number of pieces of parts can be restrained.

What is claimed is:

1. A radio wave timepiece comprising:

a movement having a main plate of circular shape and a plastic train wheel bridge;

an antenna contained in an antenna containing recess portion formed at an outer peripheral portion of the main plate proximate to an outer edge thereof;

a hand pushing receive seat of a plastic member arranged on a back side of the movement;

a fourth wheel & pinion receive pin attached to the hand pushing receive seat of the plastic member at a certain constant distance from a fourth stem of the fourth wheel & pinion;

a plurality of push up projections provided at the outer peripheral portion of the main plate; and a push up projection provided at the hand pushing receive seat of the plastic member.

2. A radio wave timepiece comprising:

a movement having a main plate of circular shape and a plastic train wheel bridge;

an antenna contained in an antenna containing recess portion formed at an outer peripheral portion of the main plate proximate to an outer edge thereof;

a hand pushing receive seat of a plastic member arranged on a back side of the movement;

a fourth wheel & pinion receive pin attached to the hand pushing receive seat of the plastic member at a certain constant distance from a fourth stem of the fourth wheel & pinion; and a plurality of push up projections provided at the outer peripheral portion of the main plate;

wherein the hand push receive seat of the plastic member also constitutes an antenna cover that partly covers the antenna containing recess portion.

3. In a radio wave timepiece having a movement that has a main plate, a plastic train wheel bridge, and time-indicating hands: an antenna extending along and beneath an outer peripheral portion of the main plate such that the main plate covers one side of the antenna, a plastic seat which is disposed at a back side of the movement and on which seats the plastic train wheel bridge and that functions as a hand pushing receive seat during attachment of the time-indicating hands to the movement; and a plurality of projections, one on the plastic seat and the others on the main plate, that project toward the back side of the movement and that support the main plate and the plastic seat to prevent destructive buckling of the plastic train wheel bridge during attachment of the time-indicating hands to the movement.

4. A radio wave timepiece according to claim 3; further including a plastic antenna cover disposed at the back side of the movement and covering an opposite side of the antenna that is opposite the one side, a portion of the plastic antenna cover constituting the plastic seat.

5. A radio wave timepiece according to claim 4; further including a stepped through-hole formed in the plastic seat, and a flanged pin inserted in the stepped through-hole and projecting therefrom toward the back side of the movement.

6. A radio wave timepiece according to claim 5; further including a fourth wheel & pinion mounted on the plastic train wheel bridge and having a fourth stem opposed to and spaced a slight distance from the flanged pin.

7. A radio wave timepiece according to claim 4; wherein the plastic antenna cover overlaps more than half of the main plate.

8. A radio wave timepiece according to claim 4; wherein the main plate has a circular shape and the plastic antenna cover has a circular arc shape.

9. A radio wave timepiece according to claim 8; wherein the plastic antenna cover overlaps more than half of the main plate.

10. A radio wave timepiece according to claim 3; further including a stepped through-hole formed in the plastic seat, and a flanged pin inserted in the stepped through-hole and projecting therefrom toward the back side of the movement.

11. A radio wave timepiece according to claim 10; further including a fourth wheel & pinion mounted on the plastic train wheel bridge and having a fourth stem opposed to and spaced a slight distance from the flanged pin.

12. A radio wave timepiece according to claim 3; further including a case back having mount holes, and the projections having front end portions inserted into respective ones of the mount holes.

13. A radio wave timepiece according to claim 12; further including a plastic antenna cover disposed at the back side of the movement and covering an opposite side of the antenna that is opposite the one side, a portion of the plastic antenna cover constituting the plastic seat.

14. A radio wave timepiece according to claim 13; further including a stepped through-hole formed in the plastic seat, and a flanged pin inserted in the stepped through-hole and projecting therefrom toward the back side of the movement.

15. A radio wave timepiece according to claim 14; further including a fourth wheel & pinion mounted on the plastic train wheel bridge and having a fourth stem opposed to and spaced a slight distance from the flanged pin.

* * * * *